United States Patent [19]

Ban et al.

[11] 4,279,289

[45] Jul. 21, 1981

[54] PROCESS FOR PREPARATION OF FIBER-REINFORCED MAGNESIUM ALLOY MATERIALS

[75] Inventors: Keisuke Ban, Fujimi; Takeo Arai, Higashimatsuyama; Akimasa Daimaru, Kawagoe, all of Japan

[73] Assignee: Honda Giken Kogyo Kabushiki Kaisha, Tokyo, Japan

[21] Appl. No.: 81,444

[22] Filed: Oct. 3, 1979

[30] Foreign Application Priority Data

Oct. 5, 1978 [JP] Japan ..... 53/122997

[51] Int. Cl.[3] ..... B22D 19/14

[52] U.S. Cl. ..... 164/97; 164/120

[58] Field of Search ..... 164/97, 100, 101, 75, 164/120; 75/135

[56] References Cited

U.S. PATENT DOCUMENTS

| | | | |
|---|---|---|---|
| 3,529,655 | 9/1970 | Lawrence | 164/97 |
| 3,547,180 | 12/1970 | Cochran | 164/97 |
| 3,744,547 | 7/1973 | Danhard | 164/75 |
| 3,828,839 | 8/1974 | Dhingra | 164/97 |
| 3,949,804 | 4/1976 | Kaneko et al. | 164/75 |
| 4,053,011 | 10/1977 | Riewald et al. | 164/97 |

*Primary Examiner*—Robert D. Baldwin
*Assistant Examiner*—K. Y. Lin
*Attorney, Agent, or Firm*—Haseltine and Lake

[57] ABSTRACT

A process for producing fiber-reinforced magnesium alloy materials with improved mechanical properties which includes the steps of placing a shaped article of silicon carbide whiskers or silica type, alumina type or silica-alumina type fibers in a casting mold, and pouring into the mold a molten matrix of a magnesium alloy at a temperature lower than 800° C. The shaped article is impregnated with the molten matrix by means of a high pressure coagulation casting method while maintaining the original configuration of the shaped article to form a composite. A magnesium-silicon compound and/or a magnesium-aluminum compound are precipitated in the matrix at the filling and composite-forming step by reaction between the surface fibers of the shaped article and the molten matrix. The whiskers or fibers may be covered by a film of copper, nickel or silver to vary the amount of the precipitated compounds.

1 Claim, No Drawings

PROCESS FOR PREPARATION OF FIBER-REINFORCED MAGNESIUM ALLOY MATERIALS

BACKGROUND OF THE INVENTION

1. Field of the Invention

The present invention relates to a process for the preparation of fiber-reinforced magnesium alloy materials.

2. Description of the Prior Art

Magnesium alloys have attracted attentions in the art as materials which will attain higher labor-saving and weight-decreasing effects than aluminum alloys, and researches have been made on applications of magnesium alloys in various fields. At the present, however, magnesium alloys are practically utilized only as semistructural materials for cases, covers and the like, and utilization of magnesium alloys for structural materials requiring a certain strength is still insufficient. This is due to poor mechanical characteristics of magnesium alloys. More specifically, magnesium alloys are much inferior to aluminum alloys in the rigidity and strength, and the mechanical properties of magnesium alloys at high temperatures are extremely poor.

Summary of the Invention

Under such background, we did research with a view to developing a fiber-reinforced magnesium alloy material having excellent mechanical properties by applying our previously proposed technique of forming reinforced inorganic fiber composite shaped materials according to the high pressure coagulation casting method.

We first examined various inorganic fibers in connection with the wetting property relative to magnesium alloys, the adaptability to composite molding with magnesium alloys and the alloy-reinforcing effects, and as a result, we found that interesting phenomena are caused between fibers and alloy melts at the fiber filling and composite molding step because of a highly oxidative action of magnesium alloys in the molten state.

More specifically, inorganic fibers having a low resistance to oxidation, such as carbon fibers, are readily oxidatively consumed and burnt at the fiber filling and composite molding step, and the reinforcing effect is extremely low in the resulting composite molded materials. Inorganic fibers having a higher oxidation resistance can be filled in magnesium alloy matrices and composite-molded with them, as in the case of conventional aluminum alloy matrices.

The most interesting phenomenon we found is that, of, ceramic fibers having a high oxidation resistance, such as silicon carbide whiskers and silica type, alumina type and silica-alumina type fibers, react with magnesium alloy melts at the fiber filling and composite-forming step and specific compounds are precipitated.

We noted these phenomena between magnesium alloys and inorganic fibers, and we succeeded in obtaining one-layer composite reinforced materials of magnesium alloys by combining the above-mentioned precipitating effect by utilizing the activity of magnesium alloys with the conventional reinforcing technique using inorganic fibers.

More specifically, in accordance with the present invention, there is provided a process for the preparation of fiber-reinforced magnesium alloy materials, which comprises placing a shaped article of silicon carbide whiskers or silica type, alumina type or silica-alumina type fibers in a casting mold, pouring as a matrix a melt of a magnesium alloy maintained at a temperature lower than 800° C. into the casting mold, filling said magnesium alloy melt into said shaped article by means of the high pressure coagulation casting method while maintaining the configuration of said shaped article to form a composite, and precipitating a magnesium-silicon compound and a magnesium-aluminum compound in said matrix at said filling and composite-forming step by reaction between the surface fibers of said shaped article and the melt.

DETAILED DESCRIPTION OF THE PREFERRED EMBODIMENTS

The reaction of the melt with the fiber surface of the shaped article of fibers is controlled by the high pressure coagulation casting conditions, the surface area of fibers (the configuration of the fiber shaped article, the fiber diameter and the bulk density of the fiber shaped article), the properties and composition of fibers and the surface treatment of fibers.

The amount of the magnesium-silicon and magnesium-aluminum compounds precipitated is large because the silicon, silica and alumina contents in the fibers are high and the amount of the precipitated compounds are larger in the case of amorphous type fibers than in the case of crystalline type fibers. Among these compounds, the magnesium-silicon compound is preferentially precipitated. The amount of the precipitated compounds can be varied by forming a film of copper, nickel, silver or the like on the fiber surface. There is a close relation between the surface area of fibers and the amount of the precipitated compounds, and excessive precipitation of the above-mentioned compounds results in occurrence of cracking during heat treatment and reduction of the strength owing to reduction of elongation. Accordingly, even in the case of fibers having a relatively low reaction rate, such as silica-alumina type crystalline fibers which have been subjected to a copper film-forming treatment, the upper limits of the fiber diameter and the bulk density are 1 to 2$\mu$ and about 0.5 g/cc, respectively.

As will be apparent from the foregoing illustration, according to the present invention, fibers are formed in advance into a shaped article having a uniform bulk density and a melt is filled in the shaped article of fibers by utilizing a hydrostatic high pressure at the composite molding step. Therefore, the melt can be filled homogeneously while retaining the form of the shaped article, and the wetting state and reactivity between the melt and fiber surface are good and appropriate. Furthermore, the fibers can be homogeneously distributed in the matrix without segregation of compounds. Moreover, by the chilling effect of fibers and the compressive coagulating effect by the high pressure, compounds are precipitated in a much finer state.

According to the present invention, by virtue of the reinforcing effect of fibers and the appropriate precipitation of the compounds, the rigidity and strength of the magnesium alloy can be highly improved, and the creep resistance at high temperatures, the buffer resistance and the abrasion resistance are especially improved.

The present invention will now be illustrated by reference to the following Example that by no means limits the scope of the invention.

EXAMPLE

This Example illustrates the manufacture of a piston for an internal combustion engine having the ring groove and skirt portion reinforced.

Application of a magnesium alloy to a piston for an internal combustion engine produces various advantages because of reduction of the load for the reciprocative motion, but this has not been actually worked because the mechanical strength of magnesium alloys is insufficient as pointed out hereinbefore.

If a magnesium alloy is used for a piston of an internal combustion engine, the following problems should especially be solved.

(1) Fatigue and abrasion are caused in the ring groove and skirt portion due to insufficient strength, hardness and abrasion resistance.

(2) The clearance is changed at the cold and hot working steps because of the thermal expansion characteristics of the magnesium alloy.

Owing to these problems, magnesium alloys are inferior to conventional aluminum alloys with respect to oil consumption, control of blow by-gases and durability.

The problem (1) is most significant when a magnesium alloy is applied to a piston, and it is eagerly desired to solve this problem. As means for solving the foregoing problems, there may be considered a method in which an abrasion-resistant rigid reinforcing ring composed of aluminum, stainless steel or the like is cast-included in a piston. This method, however, is defective in that a strength defect is caused by the weight increase and insufficient casting inclusion.

In the present Example, the above-mentioned problems (1) and (2) could be solved effectively without loss of the advantage of the weight reduction.

In the manufacture of an internal combustion engine piston having a diameter of 72 mm, annular and plate-like shaped articles having a bulk density of 0.2 g/cc were formed according to configurations of the ring grooves and skirt thrust portions of the top land and second land by using silica-alumina crystalline fibers having an average fiber diameter of 2μ, which had been subjected to a copper film-forming treatment, and these shaped articles were placed at predetermined positions in a casting mold. A melt comprising 10% of Al, 2% of Si and 0.7% of Zn with the balance being Mg, which was maintained at a temperature lower than 700° C., was cast in the mold as the matrix. A piston material was prepared under a pressure of 1500 Kg/cm$^2$ according to the high pressure coagulation casting method.

The ring groove portion of the thus prepared piston material had an outer diameter of 73 mm, an inner diameter of 60 mm and a height of 20 mm.

When the piston material was examined and analyzed, it was found that the form of the fiber shaped article was retained and fine and uniform precipitation of $Mg_2Si$ and $Mg_{17}Al_{12}$ was observed in the composite matrix.

When silica-alumina crystalline fibers which had been subjected to the copper film-forming treatment and had a fiber diameter of 2μ was used, precipitation of $Mg_2Si$ and damage of fibers were extreme if the bulk density was higher than 0.5 g/cc and the melt temperature was higher than 800° C. In this case, furthermore, cracking was caused during heat treatment and it was found that the strength was poor and the product was brittle.

Data of the hardness (HRB) and the thermal expansion coefficient (20° C.) of the piston of this Example, a piston composed solely of a magnesium alloy (Comparative Example 1) and a piston of an aluminum alloy (AC 8B specified by the Japanese Industrial Standards) (Comparative Example 2) are shown in Table 1.

TABLE 1

| | This Example | Comparative Example 1 | Comparative Example 2 |
|---|---|---|---|
| Hardness | 95 | 55 | 70 |
| Thermal Expansion Coefficient | $17 \times 10^{-6}$ | $23 \times 10^{-6}$ | $21 \times 10^{-6}$ |

The abrasion state of the top land ring groove and the skirt portion in the thrust direction after 100 hours' bench durability test is shown in Table 2.

TABLE 2

| | | (total load: 5000 rpm) | |
|---|---|---|---|
| | This Example | Comparative Example 1 | Comparative Example 2 |
| Top Land Ring Groove | 10–20μ | 50–100μ | 5–10μ |
| Skirt Portion | 15–20μ | 50–70μ | 10–20μ |

As will be apparent from the results shown in Tables 1 and 2, the piston of this Example was comparable to a conventional aluminum alloy piston with respect to strength characteristics. By virtue of these excellent strength characteristics, the fatigue and abrasion of the ring groove and skirt portion in the piston of this Example could be maintained at substantially the same low levels as in the conventional aluminum alloy piston. Furthermore, the skirt clearance could be set in the same manner as in the conventional aluminum alloy piston. Moreover, the weight of the piston in this Example could be decreased by about 30% by weight as compared with the weight of the conventional aluminum alloy piston.

What is claimed is:

1. A process for the preparation of fiber-reinforced magnesium alloy materials, which comprises placing a shaped article of silica-alumina type fibers having an average diameter of 2 microns or less and a bulk density of 0.5 g/cc or less in a casting mold, pouring as a matrix a melt of magnesium alloy maintained at a temperature lower than 800° C. into the casting mold, filling said magnesium alloy melt into said shaped article by means of a high pressure coagulation casting method while maintaining the configuration of the shaped article to form a composite, whereby a reaction between the surface fibers of said shaped article and the melt causes precipitation of a mixture of magnesium-silicon and magnesium-aluminum compounds.

* * * * *